US009732579B2

(12) United States Patent
Hiorth et al.

(10) Patent No.: US 9,732,579 B2
(45) Date of Patent: Aug. 15, 2017

(54) PLUG APPARATUS

(71) Applicant: Vosstech AS, Voss (NO)

(72) Inventors: Espen Hiorth, Trondheim (NO); Gudleik Klette, Voss (NO); Stig Ove Bjorgum, Voss (NO)

(73) Assignee: Vosstech AG, Voss (NO)

( * ) Notice: Subject to any disclaimer, the term of this patent is extended or adjusted under 35 U.S.C. 154(b) by 0 days.

(21) Appl. No.: 14/779,338

(22) PCT Filed: Mar. 6, 2014

(86) PCT No.: PCT/EP2014/054356
§ 371 (c)(1),
(2) Date: Sep. 23, 2015

(87) PCT Pub. No.: WO2014/154464
PCT Pub. Date: Oct. 2, 2014

(65) Prior Publication Data

US 2016/0060998 A1 Mar. 3, 2016

(30) Foreign Application Priority Data

Mar. 25, 2013 (NO) ..... 20130427

(51) Int. Cl.
*E21B 33/12* (2006.01)
*E21B 34/06* (2006.01)

(52) U.S. Cl.
CPC ..... *E21B 33/12* (2013.01); *E21B 33/1208* (2013.01); *E21B 34/063* (2013.01)

(58) Field of Classification Search
CPC .. E21B 33/12; E21B 33/1208; E21B 33/1204; E21B 33/134; E21B 29/00; E21B 47/1025
See application file for complete search history.

(56) References Cited

U.S. PATENT DOCUMENTS 1,790,783 A * 2/1931 Yungling ..... E21B 29/00 166/55.2
5,479,986 A * 1/1996 Gano ..... E21B 23/00 166/192

(Continued)

FOREIGN PATENT DOCUMENTS

NO WO 2012112053 A1 * 8/2012 ..... E21B 29/00
WO WO 2009/116871 9/2009
WO WO 2009/126049 Y 10/2009

OTHER PUBLICATIONS

L. Swor et al: "Self-removing frangible bridge and fracture plug" Copyright. Sep. 27, 2006 (Sep. 27, 2006), pp. 24-27, XP055128277. D01: http://dx.doi.org/10.2118/102994-MS Retrieved from internet: URL:https://www.onepetro.org/conference-paper/SPE-102994-MS [Retrieved on Jul. 10, 2014] the whole document.

(Continued)

*Primary Examiner* — Jennifer H Gay
(74) *Attorney, Agent, or Firm* — Christian D. Abel

(57) ABSTRACT

A disintegrable plug apparatus for use in connection with petroleum wells, especially during pressure testing of such petroleum wells. The plug apparatus has an outer housing surrounding at least one sealing device and a plurality of supporting bodies, where at least one of the supporting bodies is in engagement with a locking device for locking to a locking sleeve. After application of a predetermined pressure on the plug apparatus, the at least one supporting body and the at least one sealing device are permitted an axial movement such that the at least one sealing device is brought into contact with loading devices for disintegration of the at least one sealing device.

15 Claims, 13 Drawing Sheets

(56) References Cited

U.S. PATENT DOCUMENTS 5,685,372 A * 11/1997 Gano ..... E21B 23/00 166/192
5,826,661 A * 10/1998 Parker ..... E21B 23/00 166/135
7,909,104 B2 * 3/2011 Bjorgum ..... E21B 33/1208 166/192
8,322,448 B2 * 12/2012 Brandsdal ..... E21B 33/12 166/164
8,397,813 B2 * 3/2013 Brandsdal ..... E21B 33/134 166/192
9,222,322 B2 * 12/2015 Brandsdal ..... E21B 33/12
2003/0168214 A1 * 9/2003 Sollesnes ..... E21B 29/00 166/250.08
2007/0012438 A1 * 1/2007 Hassel-Sorensen E21B 33/1208 166/192
2009/0101358 A1 * 4/2009 Bjorgum ..... E21B 33/1208 166/376
2010/0163222 A1 * 7/2010 Brandsdal ..... E21B 33/134 166/192
2011/0000663 A1 * 1/2011 Brandsdal ..... E21B 33/12 166/178
2011/0000676 A1 * 1/2011 Brandsdal ..... E21B 33/12 166/317
2011/0277988 A1 11/2011 Wee
2014/0338923 A1 * 11/2014 Fripp ..... E21B 34/063 166/376
2016/0060998 A1 * 3/2016 Hiorth ..... E21B 33/12 166/192

OTHER PUBLICATIONS

Norwegian search report of Aug. 22, 2013, cited inter alia as statement of relevance for any non-English references cited therein.
ISR of Jan. 15, 2015, cited inter alia as statement of relevance for any non-English references cited therein.

* cited by examiner

DETAIL K
SCALE 2:1

DETAIL J
SCALE 2:1

DETAIL N
SCALE 2:1

DETAIL O
SCALE 2:1

DETAIL U
SCALE 2:1

DETAIL T
SCALE 2:1

PLUG APPARATUS

The present invention relates to a disintegratable plug apparatus for use in connection with petroleum wells, and in particular for use during pressure testing of such petroleum wells.

In the oil industry it is known that different types of plugs are used during pressure testing of petroleum wells, for example, before start-up of production from the well, or when extensive maintenance of the well has been carried out. A plug will then be installed in the well, after which an area of the well will be pressurised, so as to check that pipe joints, packers, valves etc. are properly installed, and whether they are also leak-tight. The plug is usually installed as a lower part of a production tubing, the plug then being arranged in a pipe element that is designed to be connected with one or more pipe elements forming the production tubing. The plug may also be arranged in an independent pipe element which will then be capable of being run down inside a liner or a casing, the liner or casing being installed in the well beforehand.

Once the pressure testing has been completed and production is to start up, the plug must be removed from the well, either by the plug being retrieved or by the whole or parts of the plug being destroyed downhole.

Such plugs comprise an outer housing, in which outer housing is arranged one or more elements that will prevent a fluid flow across the plug.

Plugs that are to be retrieved from the well may be connected to a wire (wireline) or the like, whereby the wire is used to retrieve the plug. Such plugs might, however, become wedged during retrieval or, in particular if downhole for a long time, they might have reacted with the tubing in which, for example, they are arranged, and so become stuck, which means the plugs are difficult or even impossible to bring up to the surface again.

For the above reasons, so-called destructible plugs have been developed, where the plug remains in the well, but where parts of the plug are destroyed such that a fluid flow is permitted across the plug. Such destructible plugs are made of one or more materials that will dissolve when the material/materials come into contact with a liquid, for example, a chemical or water. For instance, such a plug may be made of a rubber material, this rubber material being brought into contact with the well fluid or the chemical once testing of the well has been carried out, so as to dissolve the rubber material.

However, during operations from floating rigs, this method will be far too unreliable and slow, seen in the light of the operating costs for such a platform. In this case, it will not be possible to predict the exact time at which the plug is removed and passage through the well opens.

Such destructible plugs can also be made of a material that can be broken up or crushed by using explosives or mechanical loading devices, where this material, for example, may be of glass, ceramics or the like. Use of explosives will provide a sure removal of the plug, but will be a safety risk, and there are also many countries that have stringent requirements regarding the use and import of explosives. Mechanical loading devices are often highly complex and thus prone to faults.

It is therefore an object of the present invention to provide a plug apparatus that will provide a safe and reliable destruction of the plug apparatus.

These objects are achieved by a plug apparatus according to the attached claims, with further details of the invention set forth in the description below.

The present invention relates to a plug apparatus for carrying out tests in a petroleum well, a pipe or a borehole, the plug apparatus comprising an outer housing with a throughgoing axial bore surrounding at least one sealing device supported by a plurality of supporting bodies arranged in the throughgoing axial bore, where at least one of these supporting bodies is in engagement with a locking device for locking to a locking sleeve or a retaining sleeve and a locking ring. The at least one supporting body will, after an application of a predetermined pressure to the locking ring, be brought out of engagement with the locking device, thereby resulting in the at least one supporting body and the at least one sealing device being permitted an axial movement in the throughgoing axial bore, this axial movement causing the at least one sealing device to be brought into contact with loading devices that are designed to subject the at least one sealing device to load, so as to produce disintegration of the at least one sealing device.

One or more sealing elements may be disposed between the supporting bodies and the sealing device(s), so as to provide a leak-tight connection between them.

The plug apparatus according to the present invention may thus comprise the use of one, two, three or even more sealing devices, where a sealing device, for example, may be made of a glass material, a ceramic material or the like. It should further be understood that if several sealing devices are used in the plug apparatus, the sealing devices can be made of different material.

The sealing devices may be made in a form that is circular, polygonal etc.

The loading devices used to subject the at least one sealing device to load so as to produce a weakness of the sealing device may be in the form of one or more pin devices, spikes, blades or the like, the loading devices being suitably configured to provide substantial point loading, cutting or scratching of the sealing devices, so that the sealing devices may be more easily disintegrated.

In an embodiment of the present invention, the outer housing and one or more of the supporting bodies will then be configured with one or more recesses and/or bevelled edges for receiving the loading devices in the form of pin devices or spikes, which loading devices are adapted to subject the at least one sealing device to point loading, the recesses and/or the bevelled edges allowing the loading devices to rotate or turn in towards a centre axis in the plug apparatus on the axial movement of the supporting bodies and the at least one sealing device, so as to be able to subject the at least one sealing device to point loading.

In another embodiment of the present invention, the loading devices in the form of blades or the like will be fixedly connected to a ring element and arranged in such a way that the at least one sealing device, on being moved past the loading devices, will be cut or scratched over at least a part of the sealing device.

It should be understood that the plug apparatus according to the present invention can comprise a plurality of such loading devices which, in that case, will be arranged around the throughgoing axial bore in the outer housing. In an embodiment, the plug apparatus may comprise three such loading devices for each sealing device, which loading devices can be arranged offset 120 degrees relative to one another. However, it will be understood that more such loading devices can be used, the loading devices in that case being arranged offset differently relative to each other.

The plug apparatus can also comprise a plurality of sealing elements, which sealing elements can be arranged between the throughgoing axial bore in the outer housing and the supporting bodies and/or between the supporting bodies and the at least one sealing device.

The locking device that is used to provide locking between at least one supporting body and the locking sleeve may be formed of at least one ball, roller, pawl, shear pin or similar elements. The locking device can also be formed of a plurality of shear pins that are arranged to provide locking between at least one supporting body and the locking sleeve, whereby the shear pins after a certain load will be broken so as to release the at least one supporting body from the locking sleeve.

The at least one sealing device can in an embodiment be configured with bevelled upper and lower edges, which bevelled edges are arranged between the side edges and the upper/lower surfaces of the sealing device.

In an embodiment, one or more of the supporting bodies may be configured with one or more axial channels around their circumference, in which channel or channels a movable member is arranged. The movable member or members are used to bring the plug apparatus into its open position, whereby fluid is allowed to flow across the plug apparatus. This can be achieved in that a force is applied to the body or bodies, whereby the body or bodies, when displaced axially, will bring a locking ring or a retaining sleeve out of engagement with the locking devices, so as to allow that at least one sealing device is brought into contact with one or more loading devices.

Thus, the present invention provides a plug apparatus which disintegrates completely and where the plug apparatus gives far greater flexibility as regards structure, use and safety of such plug apparatuses.

The invention will now be described in more detail by means of non-limiting embodiments and with reference to the following figures, wherein.

To facilitate the understanding of the structure and operating principle of a plug apparatus 1 according to the present invention, the plug apparatus 1 according to the present invention is shown in the figures with one or two sealing devices 3, but these illustrated embodiments should not be interpreted as limiting embodiments.

Thus, a person of skill in the art will understand that the plug apparatus 1 according to the present invention can be made with just one sealing device 3, two sealing devices 3 or even more than two sealing devices 3, the number of sealing devices 3 depending on different parameters in the petroleum well, for example, pressure and temperature, safety etc.

A closed state of the plug apparatus should, according to the present invention, be understood to be a state in which fluid cannot flow across the plug apparatus, whilst an open state of the plug apparatus should be understood to be a state in which fluid can flow across the plug apparatus.

Figure 1C:
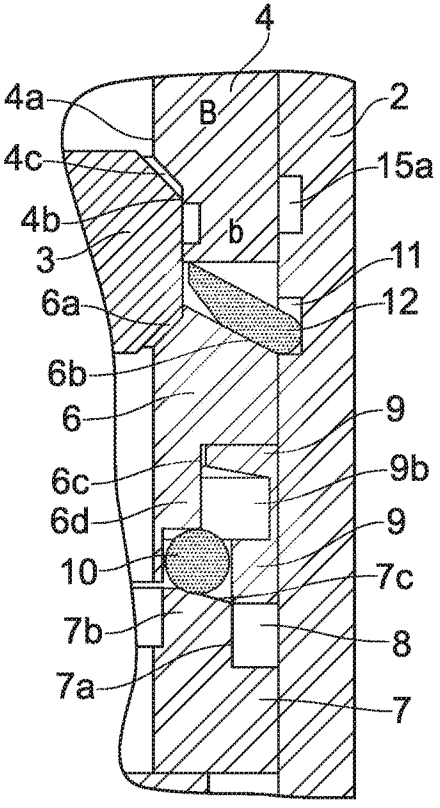
FIG. 1C is an enlarged view of detail K in FIG. 1A.
Figure 1B:
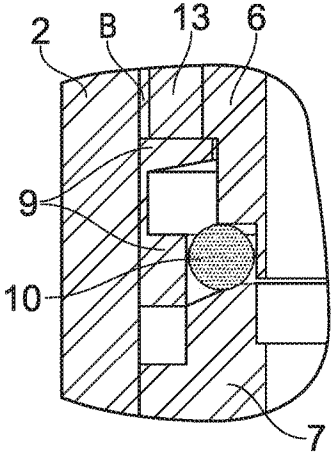
FIG. 1B is an enlarged view of detail J in FIG. 1A.
Figure 1A:
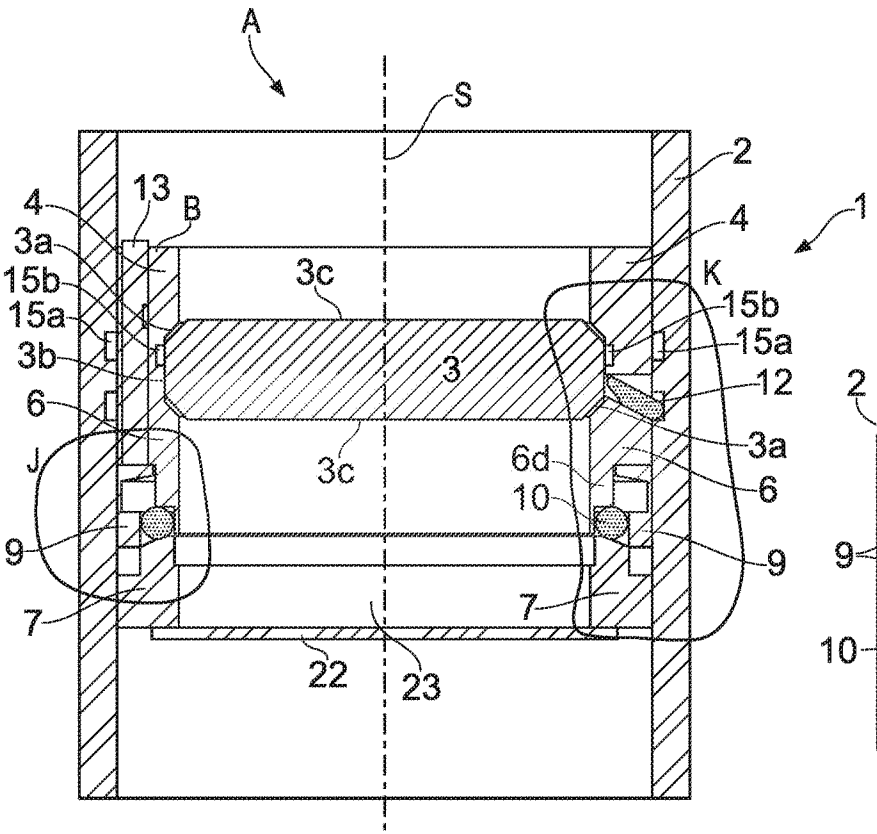
FIG. 1A is a cross-sectional view of a first embodiment of a plug apparatus according to the present invention in its closed state.

FIG. 1A shows a cross-section of a first embodiment of a plug apparatus 1 according to the present invention in a closed state, where the plug apparatus 1 comprises an outer housing 2 that is configured with a throughgoing axial bore A, in which axial bore A a sealing device 3 is arranged. The outer housing 2 may be a pipe element which by means of threads, rapid couplers or the like (not shown) can be connected to a pipe string or even be a separate element.

Alternatively, the plug apparatus 1 according to the present invention can be configured to be arranged in a pipe section (not shown), which pipe section is then configured to be connectable to one or more pipe sections, so as to, for example, form a production tubing or a pipe string in a petroleum well. The plug apparatus 1 may also conceivably be configured to be arranged in an independent pipe element, so as to be run down inside a liner or a casing, the liner or casing being installed in the well beforehand.

The sealing device 3 may be made of a glass material, a ceramic material or the like, the sealing device 3 being treated so as to be able to withstand high pressures and temperatures, but crushed when subjected to a certain load.

The axially throughgoing bore A in the outer housing 2 may be configured with a recess (not shown), in which recess two supporting bodies 4, 6 are arranged. However, it should be understood that the supporting bodies 4, 6 may also be arranged in the axially throughgoing bore A without the axially throughgoing bore A being configured with a recess. A person of skill in the art will know how this can be done, and therefore it is not further described herein.

The supporting bodies 4, 6 are preferably annular, and are designed to hold the sealing device 3 in place in the outer housing 2 when the plug apparatus 1 is assembled and in its closed state. The sealing device 3 will preferably also be annular.

The axially throughgoing bore A (i.e., the inside of the outer housing 2) is further configured with a plurality of recesses or grooves for receiving sealing elements 15*a*, the recesses or grooves extending around the circumference of the axially throughgoing bore A. This will mean that a fluid-tight connection is formed between the outer housing 2 and the supporting bodies 4, 6. Similarly, the supporting body 4, on a side facing the sealing device 3, will be configured with recess(es) or groove(s) for receiving sealing element 15*b*, the recess(es) or groove(s) extending around the inner circumference of the annular supporting body 4, so that a fluid-tight connection is also formed between the sealing device 3 and the supporting body 4.

The supporting body 4 across a first part 4*a* of its height is configured with a thickness or breadth B and across a second part 4*b* of its height is configured with a thickness or breadth b, the first and the second part 4*a*, 4*b* being connected to each other by means of a bevelled portion 4*c*. The supporting body 4 will be arranged above the supporting body 6 and abutting or bearing against the supporting body 6 when the plug apparatus 1 is assembled.

When the plug apparatus 1 according to the present invention is assembled, the bevelled portion 4*c* of the supporting body 4 will bear against a bevelled edge 3*a* of the sealing device 3, whilst the other part 4*b* of the supporting body 4 will then bear against a side edge 3*b* of the sealing device 3.

The supporting body 6 is at an end configured with two bevelled edges 6*a*, 6*b*, so as to form an "apex" in the supporting body 6, where the bevelled edge 6*a* will rest against the bevelled edge 3*a* of the sealing device 3. The other bevelled edge 6*b* of the supporting body 6 will extend down from the apex to an outside of the supporting body 6 which abuts against an inner surface of the outer housing 2. At an opposite end to the bevelled edges 6*a*, 6*b*, the supporting body 6 is configured with a recess 6*c* so as to form a projection 6*d* in the supporting body 6.

Below the supporting body 6, at a distance therefrom, a locking sleeve 7 is arranged in the axial bore A. The locking sleeve 7 is suitably fixedly connected to the outer housing 2 and is further configured with a recess 7*a* so as to form a projection 7*b* in the locking sleeve 7. The projection 7*b* is further configured with a bevelled edge 7*c* that extends down from the inside of the locking sleeve 7 to an outside of the locking sleeve 7 which abuts against an inner surface of the outer housing 2.

The recesses 6*c*, 7*a* in the supporting body 6 and the locking sleeve 7 will be so configured as to form a space or gap 8 between the outer housing 2 and the projections 6*d*, 7*b* when the plug apparatus 1 is assembled.

The projections 6*d*, 7*b* are shown with different thickness or breadth, but it should be understood that they also could be made of the same thickness or breadth.

In the space or gap 8 formed between the outer housing 2, the supporting body 6 projection 6*d* and the locking sleeve 7 projection 7*b*, a locking ring 9 is arranged, which locking ring 9 in a side facing the projections 6*d*, 7*b* is configured with a recess 9*b*.

Between the locking sleeve 7 recess 7*b* and the lower supporting body 6 projection 6*d* there is arranged a locking device 10 in the form of a ball, a roller or an element, which locking device 10 abuts against the locking ring 9 when the locking ring 9 is arranged in the space or gap 8 between the outer housing 2 and the projections 6*d*, 7*b* of the supporting body 6 and the locking sleeve 7.

When the plug apparatus 1 according to the present invention is assembled and is in a closed state, the bevelled portion 6*a* of the supporting body 6 will bear against the bevelled edge 3*a* of the sealing device 3, whilst the bevelled portion 6*b* will rest against a plurality of recesses 11 formed in the axially throughgoing bore A in the outer housing 2.

In each of these recesses 11 is arranged a loading device 12, for example, in the form of a pin or spike device, the loading device 12 being so configured that a part of the loading device 12 will be received in the recess 11 in the outer housing 2, whilst the rest of the loading device 12 will rest against the bevelled edge 6*b* of the supporting body 6. Because of the bevelled edge 6*b*, the loading devices 12 will not be in contact with the sealing device 3 when the plug apparatus 1 is in its closed state.

In this embodiment of the plug apparatus 1, three such loading devices 12 (only one is shown) are provided around an outer circumference of the sealing device 3, the loading devices 12 being arranged offset 120 degrees relative to one another.

However, it will be understood that more such loading devices 12 can be used, the loading devices 12 in that case being arranged offset differently relative to each other.

A channel B is formed through the supporting bodies 4, 6, in which axial channel B a movable member 13 is arranged. When the plug apparatus 1 is assembled, the movable member 13 will abut against an upper side of the locking ring 9 (see FIG. 1B). In this embodiment of the plug apparatus 1, three such members 13 (only one is shown) are arranged around an outer circumference of the sealing device 3, the members 13 being arranged offset 120 degrees relative to one another. The members 13 are used to bring the plug apparatus 1 into its open state, whereby fluid is allowed to flow across the plug apparatus 1. This will be explained in more detail in relation to the other embodiments of the plug apparatus 1.

To protect the different elements of the plug apparatus 1 from the well fluid when the plug apparatus 1 has been run down into the petroleum well, a membrane 22 is connected to a lower end of the locking sleeve 7. The space formed between the sealing device 3 and the membrane 22 can then be filled with an oil, silicon grease or the like. Such an arrangement including membrane and oil, silicon grease or the like can also be provided on an upper side of the plug apparatus, and a person of skill in the art will understand how this is to be done.

Through the design of the plug apparatus 1 described above, the supporting bodies 4, 6 and the sealing device 3 will be secured in their position by the locking sleeve 7, the locking ring 9 and the locking device 10.

FIG. 1B is an enlarged view of detail J (left-hand side of the plug apparatus 1 shown in FIG. 1A) whilst FIG. 1C is an enlarged view of detail K (right-hand side of the plug apparatus 1 shown in FIG. 1A).

Figure 2C:
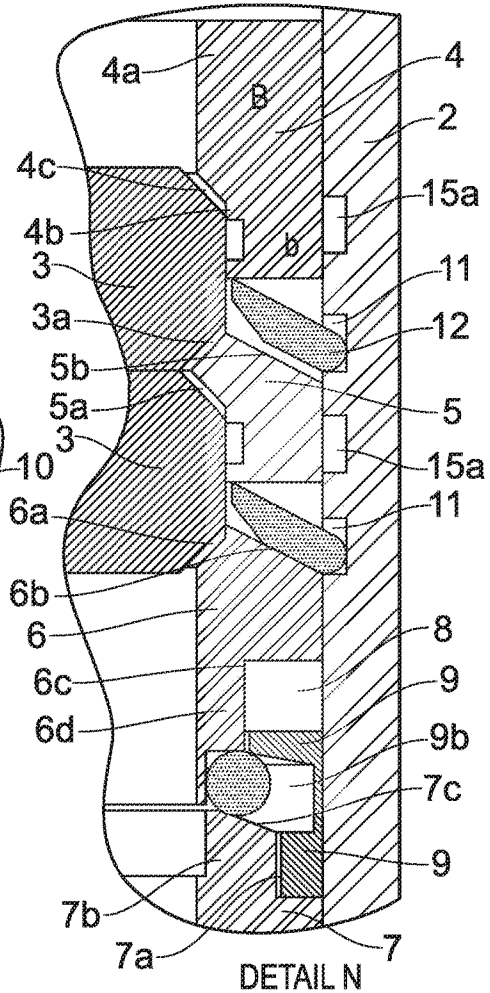
FIG. 2C is an enlarged view of detail N in FIG. 2A.
Figure 2B:
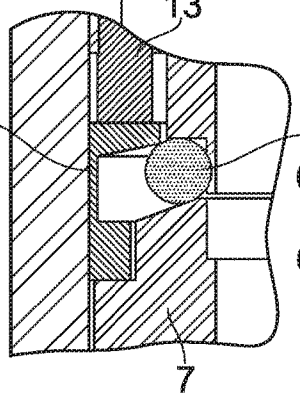
FIG. 2B is an enlarged view of detail O in FIG. 2A.
Figure 2A:
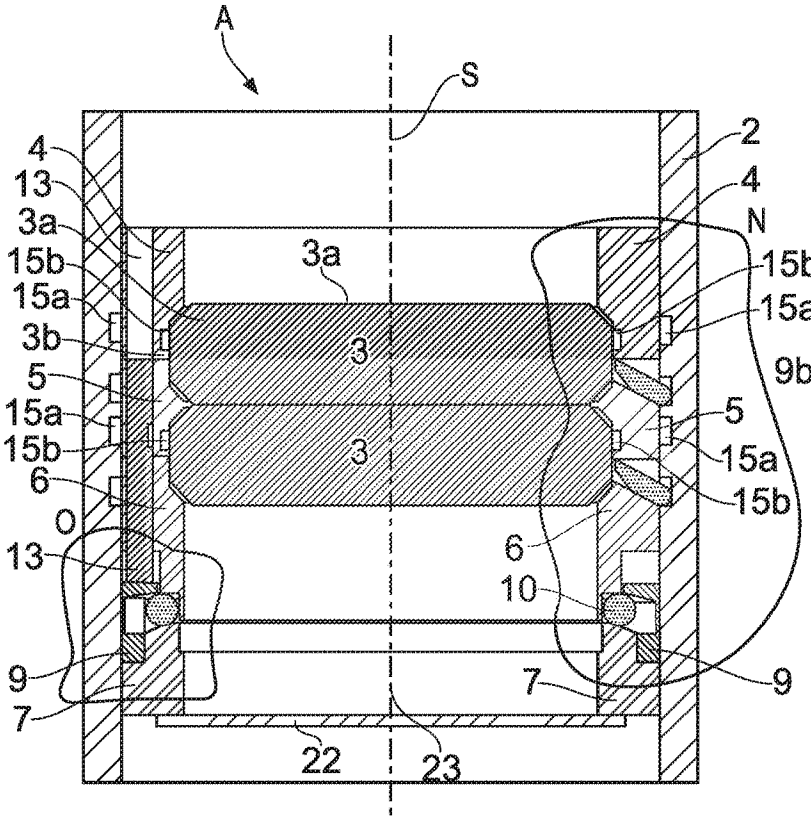
FIG. 2A is a cross-sectional view of a second embodiment of a plug apparatus according to the present invention in its closed state.

FIG. 2A shows a cross-section of a second embodiment of a plug apparatus 1 according to the present invention in a closed state, where the plug apparatus 1 comprises an outer housing 2, in which outer housing 2 are arranged two sealing devices 3. The outer housing 2 may, for example, be a pipe element that can be connected to a pipe string or be an independent element.

Each sealing device 3 can be made of a glass material, a ceramic material or the like. If several sealing devices 3 are used in the plug apparatus 1 according to the present invention, the sealing devices 3 can be made of different material.

The outer housing 2, on an inside, is configured with an axially throughgoing bore A, in which recess supporting bodies 4, 5, 6 are arranged. The supporting bodies 4, 5, 6, which preferably are annular, are designed to hold the sealing devices 3 in place in the outer housing 2 when the plug apparatus 1 is assembled.

To obtain a leak-tight connection between the inner surface of the outer housing 2 and the supporting bodies 4, 5, 6, a plurality of sealing elements 15*a* are disposed between the outer housing 2 and the supporting bodies 4, 5, 6. In this case, either the supporting bodies 4, 5, 6 or the outer housing 2 can be configured with grooves or slots for receiving the sealing elements 15*a*.

The supporting body 4 will then constitute an upper supporting body for the upper sealing device 3, whilst the supporting body 6 will constitute a lower supporting body for the lower sealing device 3. Between the upper supporting body 4 and the lower supporting body 6 is arranged a middle supporting body 5, which middle supporting body 5 is configured with a projection 5*a*. The supporting body 5 projection 5*a* will then be designed to cooperate with the bevelled edges 3*a* of a sealing device 3 so as to ensure that each sealing device 3 is arranged properly in relation to the supporting body 5. The supporting body 5 is further configured with a bevelled upper edge 5*b*, which bevelled edge 5*b* will extend down from an inside of the supporting body 5 which rests against the side edge 3*a* of the sealing devices 3 to an outside of the supporting body 5 which abuts against an inner surface of the outer housing 2.

The upper supporting body 4 is also designed to bear against a bevelled edge 3*a* of the sealing device 3, the supporting body 4 over a first part 4*a* of its height being configured with a thickness or breadth B and over a second part 4*b* of its height being configured with a smaller thickness or breadth b, wherein the first and the second part 4*a*, 4*b* are connected to each other by means of a bevelled portion 4*c*. When the plug apparatus 1 is assembled, the bevelled portion 4*c* and the second part 4*b* of smaller thickness or breadth b will rest against the bevelled edge 3*a* and side edge 3*b* of the sealing device 3.

The lower supporting body 6 will at an end be configured with two bevelled end edges 6*a*, 6*b*, so as to form an "apex" in the supporting body 6, where one of the bevelled edges 6*a* will abut against the bevelled edge 3*a* of the sealing device 3. The other bevelled edge 6*b* will extend down from the apex to an outside of the supporting body 6 which rests against an inner surface of the outer housing 2. At an opposite end to the bevelled end edges 6*a*, 6*b* (the apex), the supporting body 6 is configured with a recess 6*c* so as to form a projection 6*d* in the supporting body 6.

Below the lower supporting body 6, at a distance therefrom, a locking sleeve 7 is provided internally in the housing 2. The locking sleeve 7 is suitably connected to the inner surface of the outer housing 2 and is further configured with a recess 7*a* to form a projection 7*b* in the locking sleeve 7. The locking sleeve 7 projection 7*b* is further configured with a bevelled edge 7*c* that extends down from an inside of the locking sleeve 7 to an outside of the locking sleeve 7 which rests against an inner surface of the outer housing 2.

The recesses 6*a*, 7*a* in the lower supporting body 6 and the locking sleeve 7 will be so configured that a gap 8 is formed between the outer housing 2 and the projections 6*d*, 7*b* when the plug apparatus 1 is assembled.

In an embodiment, the projections 6*d*, 7*b* have a different thickness, but they can also be configured with the same thickness.

In the space 8 formed between the outer housing 2 and the projection 6*d* of the lower supporting body 6 and the projection 7*b* of the locking sleeve 7, a locking ring 9 is provided, which locking ring 9 in a side facing the projections 6*d*, 7*b* is configured with a recess 9*b*.

Between the locking sleeve 7 and the lower supporting body 6 there is arranged a locking device 10 in the form of a ball, a roller or an element, which locking device 10 rests against the locking ring 9 when the locking ring 9 is arranged in the gap 8 between the outer housing 2 and the projections 6*d*, 7*b* of the supporting body 6 and the locking sleeve 7.

Each of the bevelled edges 5*b*, 6*b* of the middle supporting body 5 and the lower supporting body 6 will, when the plug apparatus 1 is assembled, abut against and be aligned with a recess 11 formed on the inner surface of the outer housing 2. In each of these recesses 11 is arranged a loading device 12, for example, in the form of a pin or spike device, the loading device 12 being so configured that a part of the loading device 12 will be received in the recess 11 in the outer housing 2, whilst the rest of the loading device 12 will rest against the bevelled edges 5*b*, 6*b* of the middle and the lower supporting bodies 5, 6. Because of the bevelled edges 5*b*, 6*b*, the loading devices 12 will not be in contact with the sealing devices 3 in this position of the plug apparatus 1.

In this embodiment of the plug apparatus 1 according to the present invention, three such loading devices 12 (only one is shown) are arranged around an outer circumference of each sealing device 3, the loading devices 12 being arranged offset 120 degrees relative to one another. However, it should be understood that the loading devices 12 can be offset differently relative to each other.

To protect the different elements of the plug apparatus 1 from the well fluid when the plug apparatus 1 has been run down into the petroleum well, a membrane 22 is connected to a lower end of the locking sleeve 7. The gap formed between the sealing device 3 and the membrane 22 can then be filled with oil, silicon grease or the like.

Through the design of the plug apparatus 1 described above, the supporting bodies 4, 5, 6 and the sealing devices 3 will be secured in their position by the locking sleeve 7, the locking ring 9 and the locking device 10.

In FIG. 2B, which is an enlarged view of detail O of the plug apparatus 1 shown in FIG. 2A, it is seen that a force F has been applied to the body 13 (only the one body 13 is shown in the figures), the body 13 having pushed the locking ring 9 down into the gap 8. The locking ring 9 has been pushed so far down that the recess 9*b* will be aligned with the locking device 10. The locking device 10 here has not yet been pushed into the recess 9*b*, but will, because of the bevelled edge 7*c* of the locking sleeve and the force transferred from the well fluid that is on the upper side of the upper sealing device 3, through the sealing devices 3 and the supporting bodies 4, 5, 6 to the locking device 10, be pushed out of the recess 9*b* in the locking ring 9.

Figure 3C:
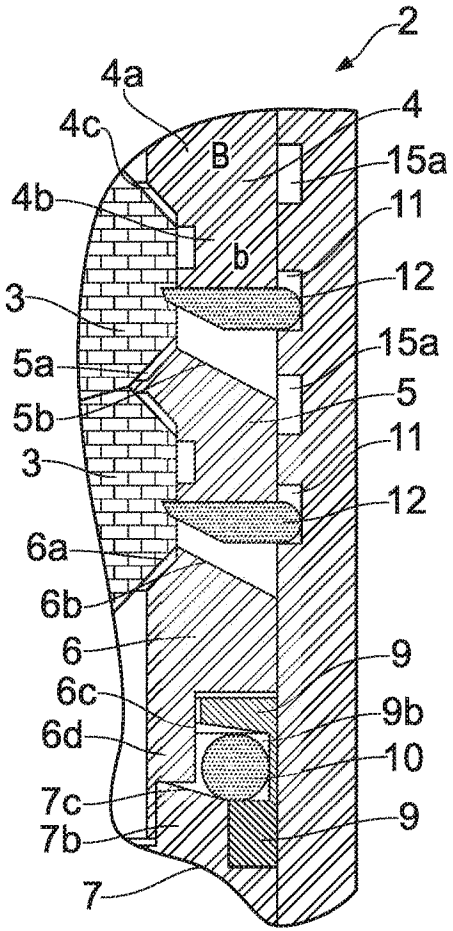
FIG. 3C is an enlarged view of detail U in FIG. 3A.
Figure 3B:
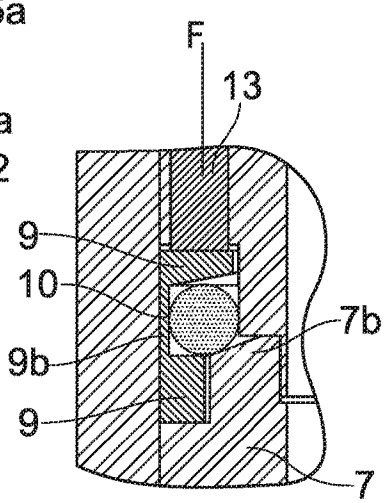
FIG. 3B is an enlarged view of detail T in FIG. 3A.
Figure 3A:
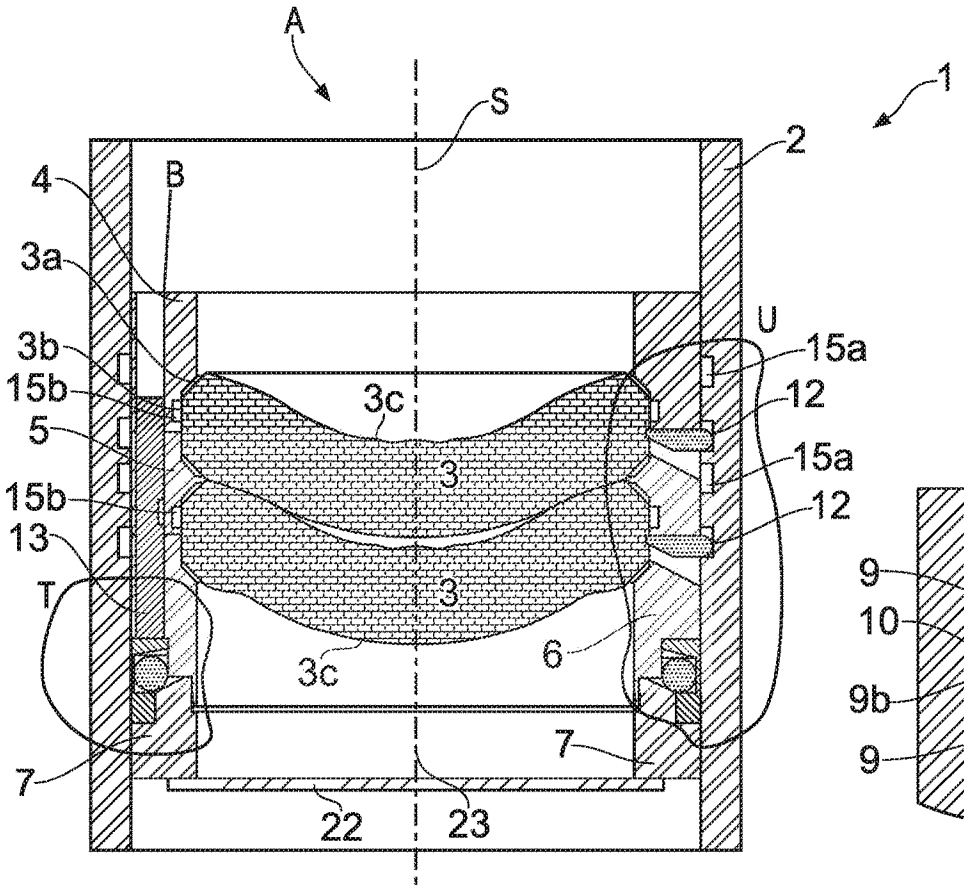
FIG. 3A is a cross-sectional view of the plug apparatus according to FIG. 2 as it is brought into its open state.

Because of the bevelled edge 7*c* of the locking sleeve 7 and the weight of fluid that rests on the upper side of the upper sealing device 3, which weight is transferred from the sealing devices 3 to the supporting bodies 4, 5, 6, the locking device 10 has in FIG. 3A been forced radially outwards into the recess 9*b* of the locking ring 9. This means that the support of the lower supporting body 6 is removed (the locking device 10 is forced out into the recess 9*b* of the locking ring 9), whereby the sealing devices 3 and the supporting bodies 4, 5, 6, on being subjected to the weight of the fluid, will be moved a distance axially downwards in the outer housing 2, towards the locking sleeve 7 so as to be brought into abutment with the locking sleeve 7, The axial distance the sealing devices 3 and the supporting bodies 4, 5, 6 move will correspond to the height of the locking device 10.

In FIGS. 3B and 3C it is seen that the axial movement of the sealing devices 3 and the supporting bodies 4, 5, 6 towards the locking sleeve 7 has caused the loading devices 12, arranged between the supporting bodies 4, 5 and the supporting bodies 5, 6 to follow this axial movement together with the sealing devices 3 and the supporting bodies 4, 5, 6. The loading devices 12 will thus be "rotated" about the recesses 11 in the outer housing 2 and in towards a centre axis S in the plug apparatus 1, so as to be brought into contact with the seals 3. When the seals 3 and the supporting bodies 4, 5, 6 have moved such that the lower supporting body 6 has been brought into engagement with the locking sleeve 7, the loading devices 12 will have "rotated" so much that they will be perpendicularly arranged on the side edges 3*b* of the sealing devices 3, which will give such large point loading on the sealing devices 3 that they will break open. The load of the weight of the fluid that lies on the upper side of the upper sealing device 3 will then first cause the sealing devices 3 to bend or sag a little before they disintegrate.

As stated above, three such loading devices 12 will be arranged around the circumference of each sealing device 3, thereby facilitating the disintegration of the sealing devices 3 and also ensuring that each sealing device 3 disintegrates completely. The loading devices 12 in the form of spikes or pin devices will then, for example, be arranged offset 120 degrees relative to one another. A person of skill in the art will however understand that the plug apparatus 1 according to the present invention could be made having fewer or more such loading devices 12, and that the loading devices 12 may be offset differently relative to each other.

The loading devices 12 will further be configured to produce greatest possible load on the side edges 3*b* of the sealing device 3, for example, with a tapered or pointed configuration at one end which provides the point loading on the side edges 3*b* of the sealing devices 3.

FIG. 3A shows in an exaggerated manner how the sealing devices 3 bend or sag with the intention of illustrating the load they are subjected to; however, the sealing devices 3 will disintegrate before they have reached such a degree of bending or sagging.

Figure 4A:
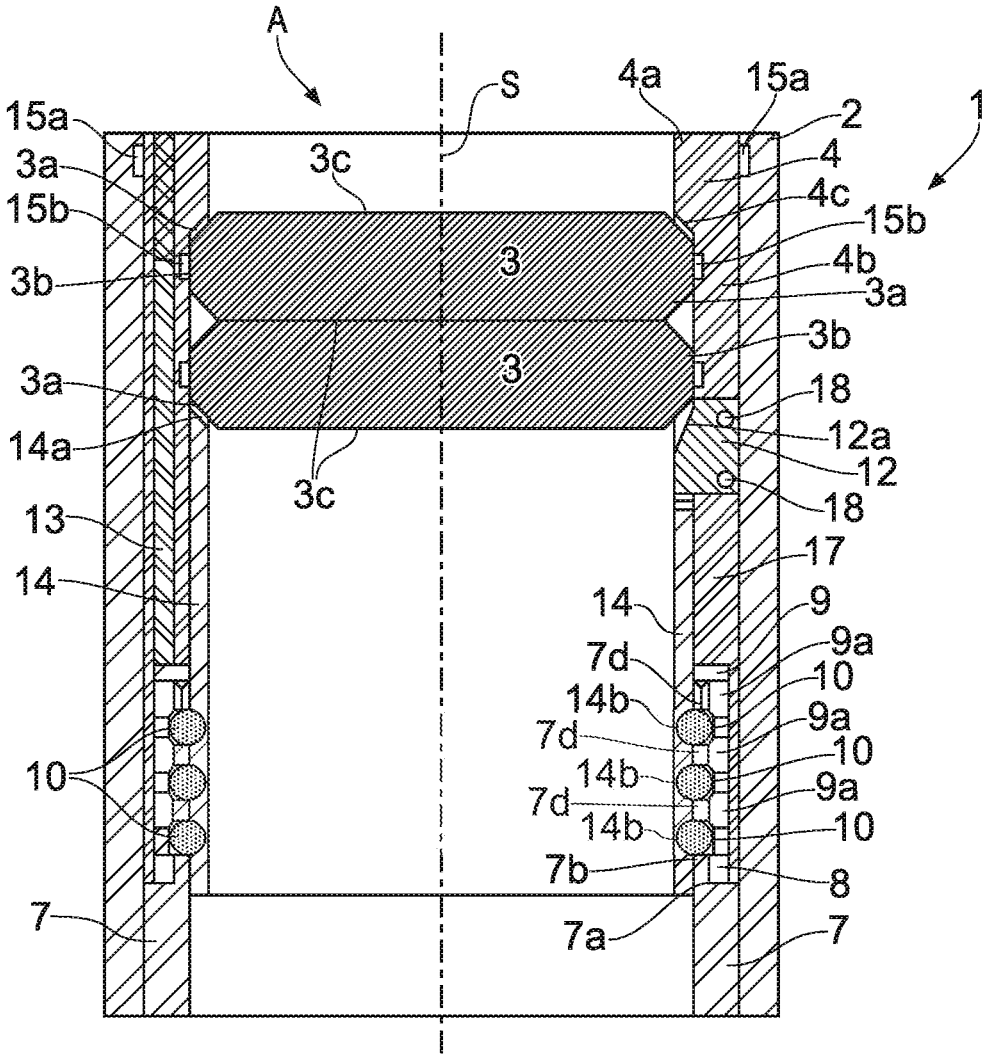
FIG. 4A is a cross-sectional view of a third embodiment of a plug apparatus according to the present invention in its closed state.

FIG. 4A shows a second embodiment of a plug apparatus 1 in its closed state according to the present invention, where the plug apparatus 1, to facilitate the understanding of the structure and operating principle of the plug apparatus 1, is presented with two sealing devices 3. The plug apparatus 1 according to this embodiment may thus comprise only one sealing device 3, or also more than two sealing devices 3.

The plug apparatus 1 comprises an outer housing 2 with an axial throughgoing bore A, so as to be able to receive an upper supporting body 4 and a ring element 17 in the axially throughgoing bore A. When the plug apparatus 1 is assembled, two sealing devices 3 will be disposed between the upper supporting body 4 and the retaining sleeve 14 arranged below. The retaining sleeve 14 will then be arranged on an inside of the ring element 17.

Each sealing device 3 is configured with four bevelled edges 3*a*, when seen in cross-section, formed between the side edges 3*b* and upper and lower surfaces 3*c* of the sealing device 3, so as by means of the bevelled edges 3*a* and side edges 3*b* to form retaining surfaces against the upper supporting body 4 and the retaining sleeve 14.

The upper supporting body 4 is designed to rest against the bevelled edges 3*a* and side edge 3*b* of the sealing device 3, the upper supporting body 4 over a first part 4*a* of its height being configured with a thickness or breadth B, whilst the upper supporting body over a second part 4*b* of its height is configured with a smaller thickness or breadth b, the first and the second part 4*a*, 4*b* being connected to each other by a bevelled portion 4*c*.

When the plug apparatus 1 according to the present invention is assembled, the upper supporting body 4 will abut against a ring element 17 arranged therebelow, which ring element 17 will abut against a locking sleeve 7 arranged therebelow. The locking sleeve 7 will then be suitably fixedly connected to the inner surface of the outer housing 2. The locking sleeve 7 is further configured with a recess 7*a* which will form a projection 7*b* in the locking sleeve 7, in which projection 7*b* three through openings 7*d* are formed. This will mean that a gap 8 is formed between the outer housing 2, the ring element 17 and the locking sleeve 7 projection 7*b*, in which gap 8 a locking ring 9 is arranged.

To produce disintegration of the plug apparatus 1 sealing devices 3, the plug apparatus 1 also comprises a loading device 12, for example, in the point of a blade arrangement, which loading device 12, via two bolts 18 or the like, is connected to the ring element 17. The loading device 12 will on a side facing the sealing devices 3 be configured at least over a part of its height with sloping edge 12*a*, which sloping edge 12*a* slopes downwards and outwards towards a centre axis S in the plug apparatus 1. In the side facing the inner surface of the outer housing 2, the loading device 12 is configured with a vertical edge, such that the loading device 12 can be arranged against the inner surface of the outer housing 2. This embodiment of the loading device 12 will mean that the sealing devices 3 will be subjected to increasing load as they are moved past the loading device 12. The loading device 12 will then extend in towards a centre axis S of the plug apparatus 1 with a width that results in at least a part of the bevelled edge 3*a* and side edge 3*b* of the sealing devices 3 being subjected to a cutting open or scratching by the loading element 12.

Preferably, three such loading devices 12 are arranged around the inner circumference of the outer housing 2, the loading devices 12 being, for example, arranged offset 120 degrees relative to one another. However, it should be understood that fewer or more such loading devices 12 can be used, and the loading devices 12 can be offset differently relative to each other.

The retaining sleeve 14 will also be configured with a bevelled end edge 14*a* that is adapted to abut against the bevelled edge 3*a* of the lower sealing device 3 when the plug apparatus 1 is assembled, so as to form a support for the sealing devices 3 and the upper supporting body 4. The bevelled edge 14*a* will extend downwards from an outside of the retaining sleeve 14 and towards an inside of the retaining sleeve 14.

The retaining sleeve 14, at the opposite end to the bevelled edge 14*a*, in an end area on its exterior, is configured with three recesses 14*b*, which recesses 14*b* are arranged spaced apart. Each of the recesses 14*b* is further designed to be able to receive a part of a locking device 10 in the form of a ball, a roller, pawl or an element, so as to form a locking to the locking sleeve 7 which is arranged on the outside of the retaining sleeve 14. The locking sleeve 7 will then be configured with three through openings 7*d* for receiving a part of the locking devices 10.

The locking ring 9 will then be configured with three recesses 9*a* in a side facing the locking sleeve 7 projection 7*b*.

It should be understood that more or fewer than the three locking devices mentioned above may be used, the locking sleeve 7 and the locking ring 9 then being configured with as many through openings 7*d* and recesses 9*a*.

When the plug apparatus 1 according to the present invention is assembled, the recesses 14*a* in the retaining sleeve 14 and the through openings 7*d* in the locking sleeve 7 projection 7*b* will be so arranged as to be aligned with each other, such that the recesses 14*a* in the retaining sleeve 14 will receive a part of the locking devices 10, in the same way as the through openings 7*d* in the locking sleeve 7 projection 7*b* will receive a part of the locking devices 10. The retaining sleeve 14 and the locking sleeve 7 will then be locked to each other in this position, the locking ring 9 that is arranged in the gap 8 between the retaining sleeve 14 and the inner surface of the outer housing 2 preventing the locking devices 10 from moving radially outwards to the sides. The recesses 9*a* in the locking ring 9 will then be arranged in such a way that each recess 9*a* is arranged above its associated through opening 7*d* in the locking sleeve 7 projection 7*b*.

Through the design of the plug apparatus 1 described above, the sealing devices 3 and the retaining sleeve 14 will be "hanged off" and are secured in position by the locking sleeve 7, the locking ring 9 and the locking devices 10.

Figure 4B:
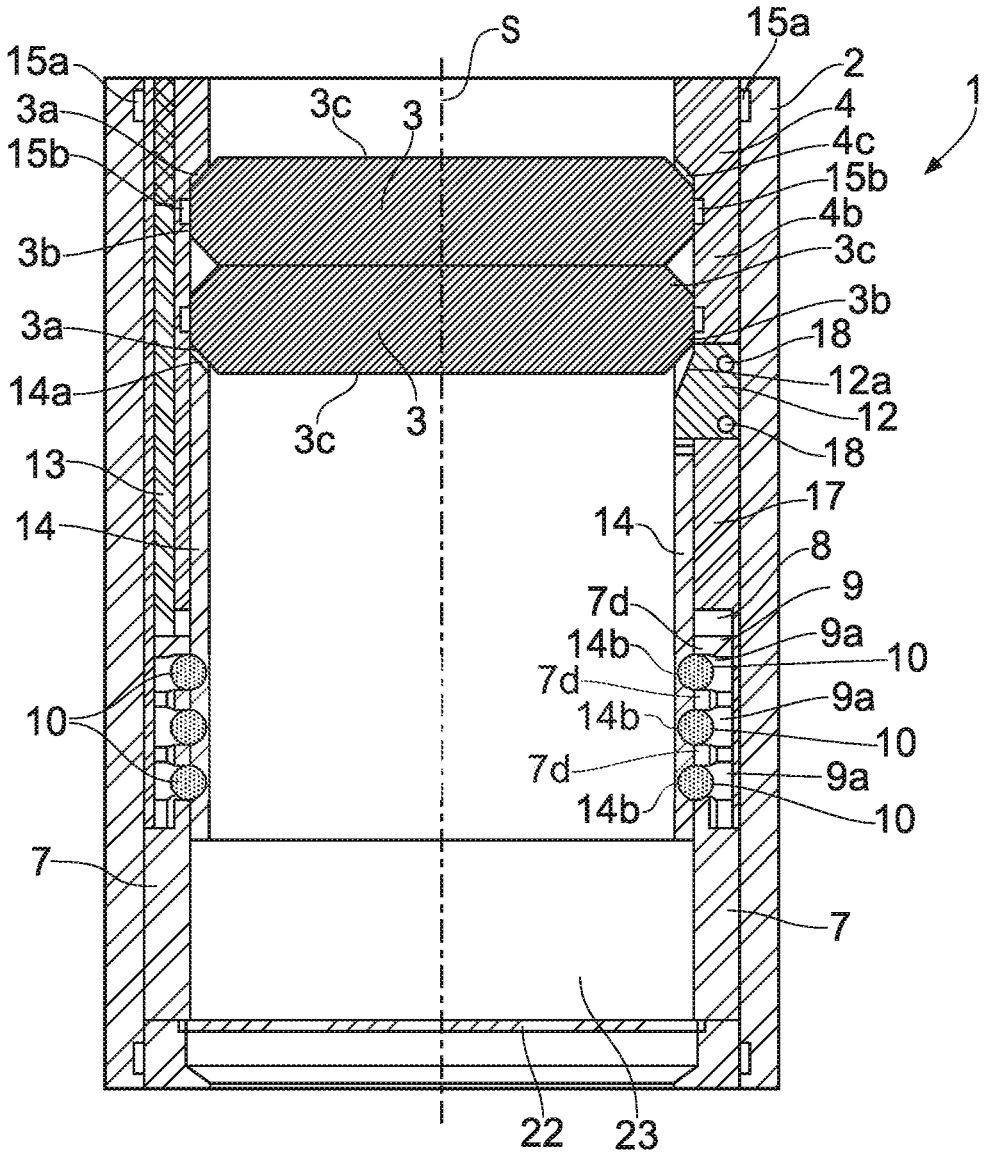
FIGS. 4B-4E are cross-sectional views of the plug apparatus according to FIG. 4A as it is bought into its open state.

FIG. 4B shows a plug apparatus 1 according to the present invention as it is activated to be brought into an open state (i.e., prior to a disintegration of the plug apparatus 1), where the locking ring 9 is subjected to a force F from a body 13 (not shown in FIG. 4B) arranged in a bore B (not shown in FIG. 4B) in the outer housing 2, the bore extending in the longitudinal direction of the plug apparatus 1. When the locking ring 9 is subjected to this force F, the locking ring 9 will be pushed so far down that the recesses 9*a* in the locking ring 9 will be aligned with the through openings 7*d* provided in the locking sleeve 7 projection 7*b*. Due to the weight of the fluid that lies on an upper side of the upper sealing device 3, which weight is transferred from the sealing devices 3 to the retaining sleeve 14, the locking devices 10 will be forced radially out of the recesses 14*b* in the retaining sleeve, through the through openings 7*d* in the locking sleeve 7 and into the locking ring 9 recesses 9*a*. This means that the support of the retaining sleeve 14 is removed, whereby the sealing devices 3 and the retaining sleeve 14, on being subjected to the weight of the fluid, will move a distance axially downwards in the outer housing 2, towards a receiving part 16 for the retaining sleeve 14.

FIG. 4B further shows that the retaining sleeve 14 and the sealing devices 3 have moved a distance downwards in the outer housing 2, this downward movement having resulted in the lower sealing device 3 almost having been moved right past the loading device 12 (only one loading device 12 is shown), whereby this sealing device 3 has been cut open or scratched.

Figure 4C:
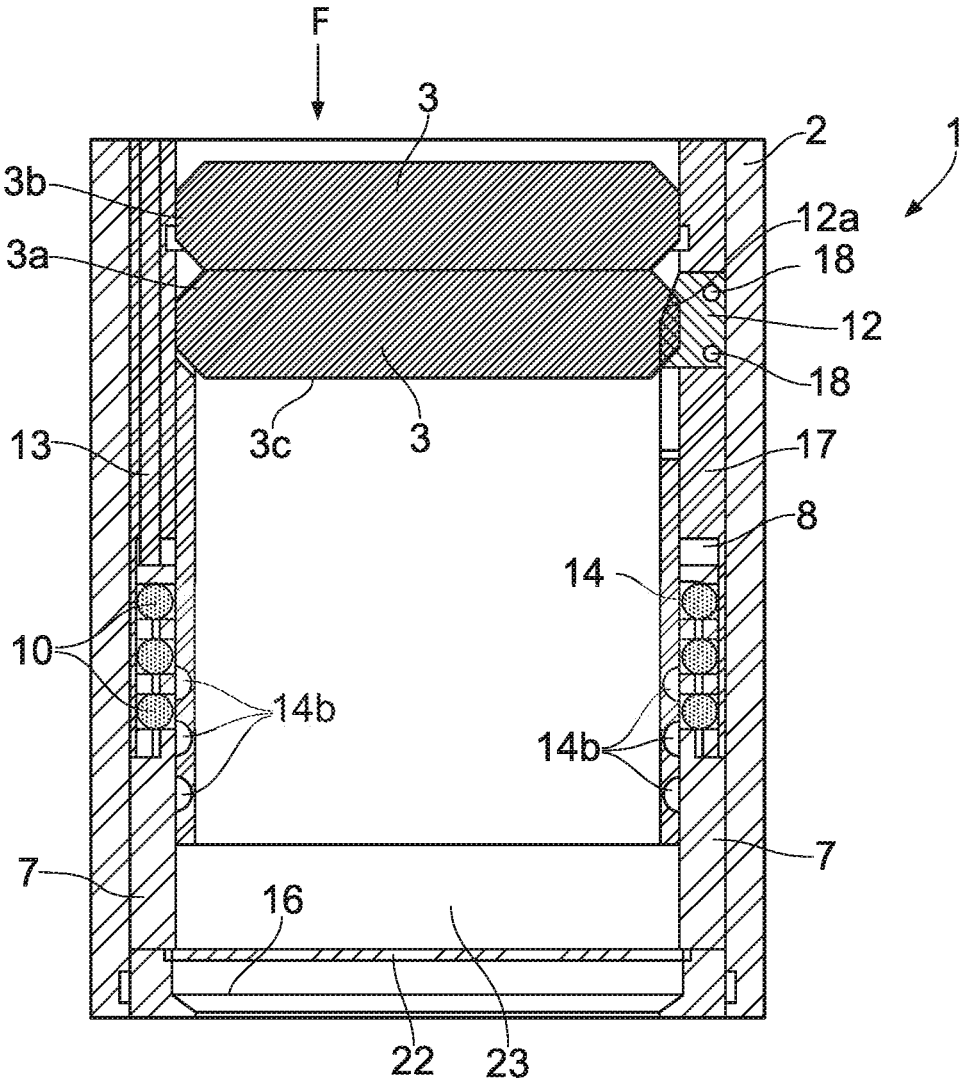

FIG. 4C shows that the retaining sleeve 14 and the sealing devices 3 have moved a further distance downwards in the outer housing 2, this downward movement having resulted in also the upper sealing device 3 almost having been moved right past the loading device 12, whereby this sealing device 3 is in the process of being completely cut open or scratched.

Figure 4D:
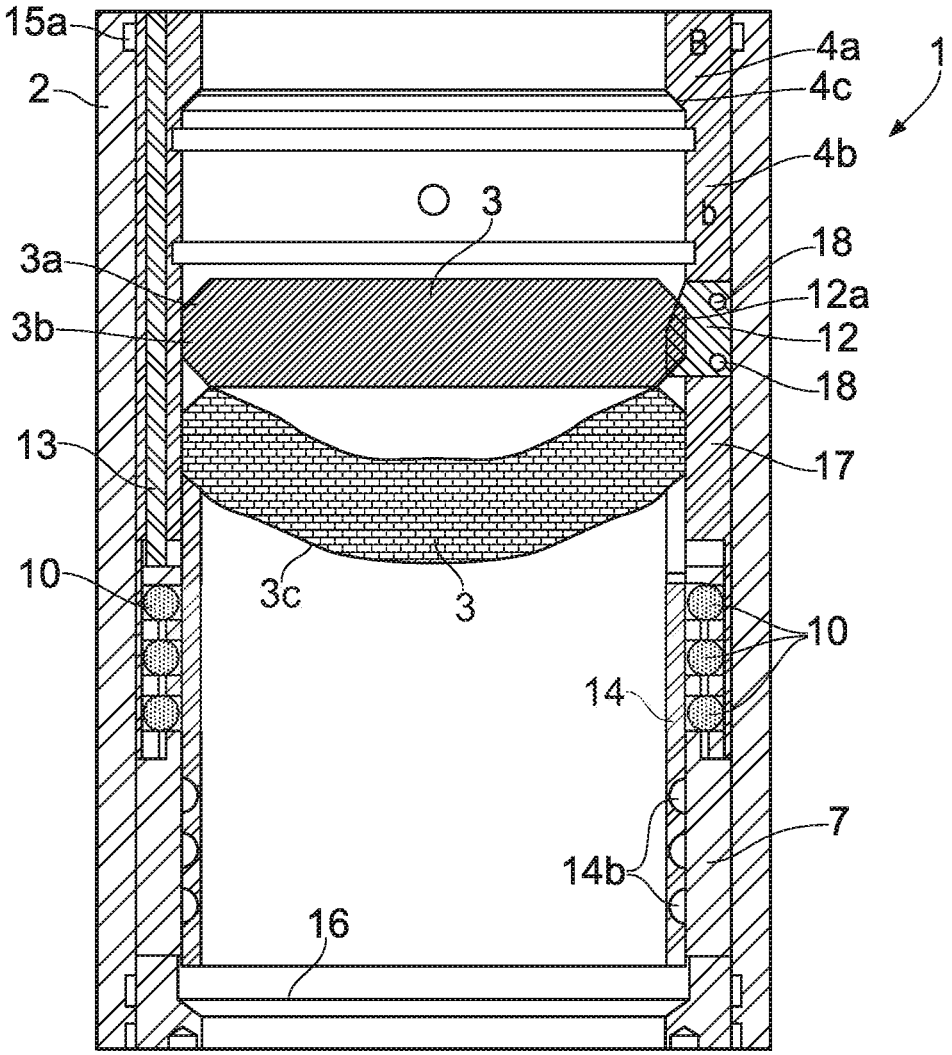

FIG. 4D shows that the retaining sleeve 14 and the sealing devices 3 have moved to a position in which the retaining sleeve 14 has come into abutment against the receiving part 16, whereby both sealing devices 3 have been moved across and past the loading device 12, which has resulted in the sealing devices 3 being weakened. The load of the weight of the fluid that lies on an upper side of the upper sealing device 3 will then cause the sealing devices 3 to disintegrate.

Figure 4E:
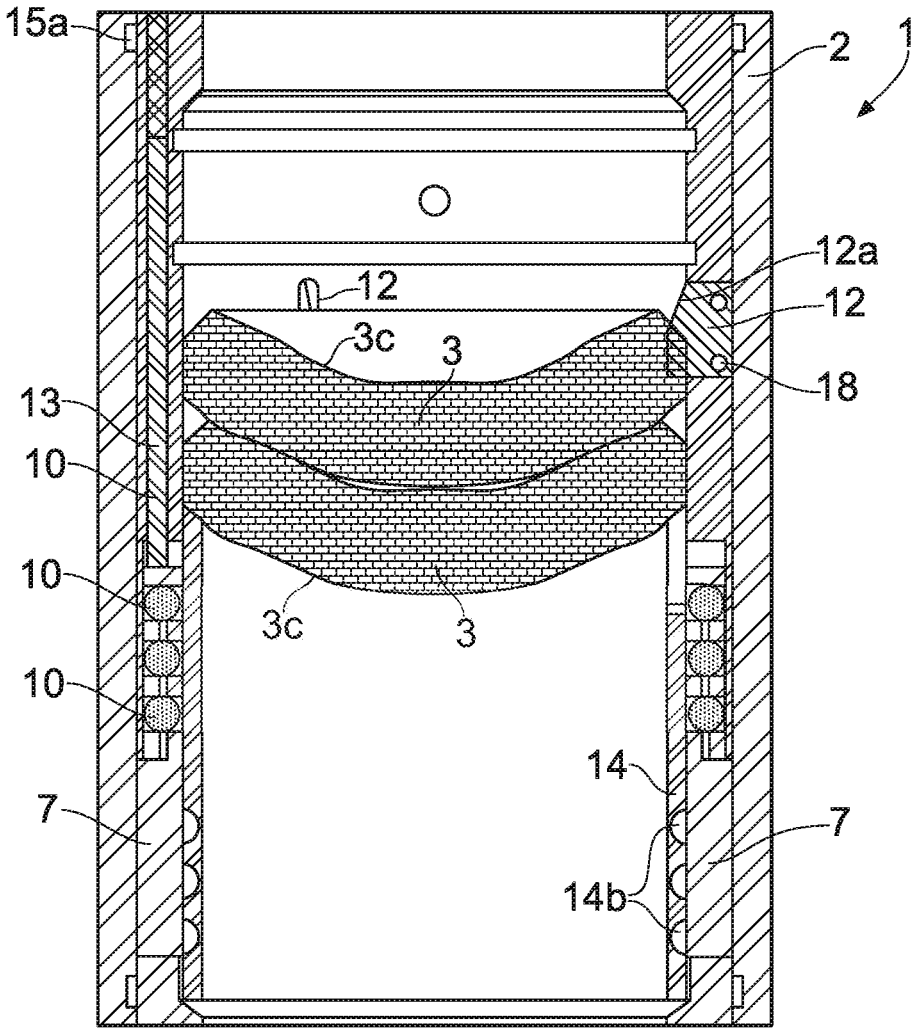

FIG. 4E shows in an exaggerated manner how the sealing devices 3 bend or sag with the intention of illustrating the load they are subjected to; however, the sealing devices 3 will disintegrate before they have reached such a degree of bending or sagging.

Figure 5:
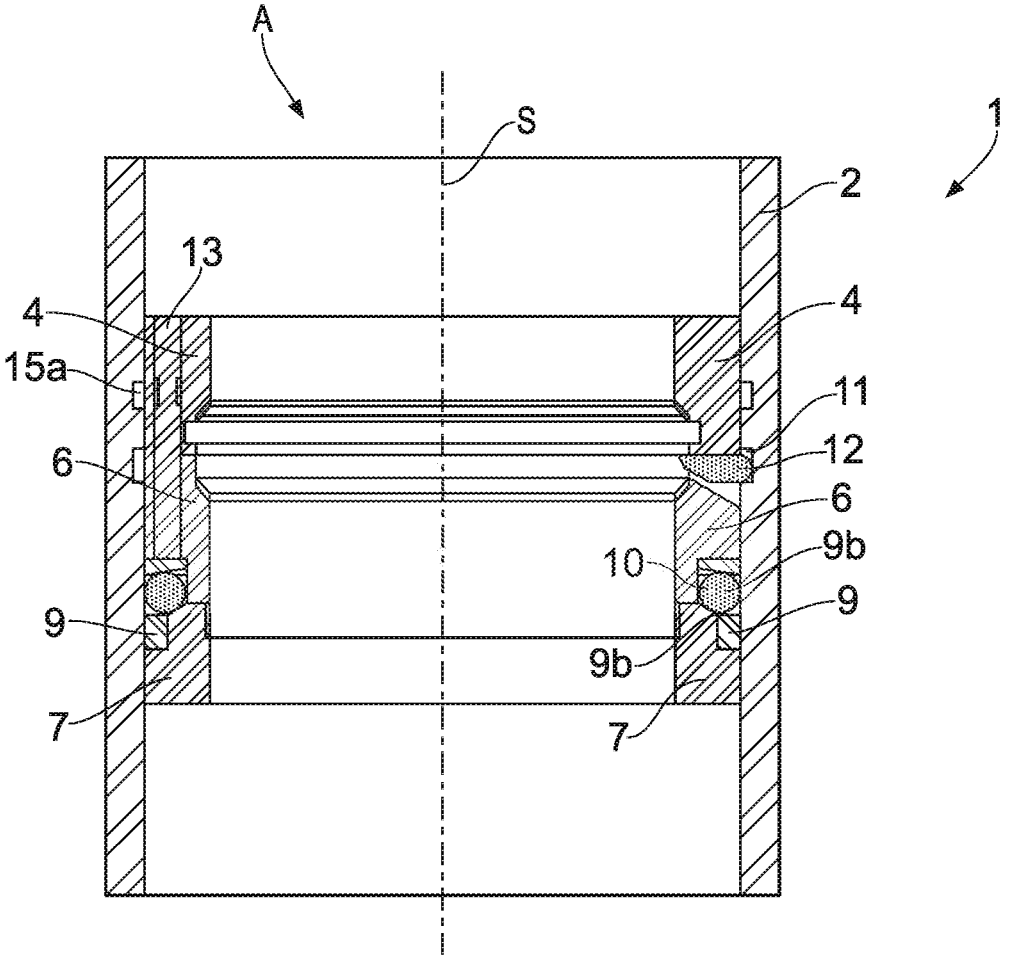
FIG. 5 is a cross-sectional view of the plug apparatus according to FIG. 1A in its open state.

FIG. 5 shows a cross-section of the plug apparatus 1 according to FIGS. 1A-1C in its open state, where it can be seen that the locking ring 9, as a result of an influence of the body 13, has been pushed downwards in the plug apparatus 1, such that the locking device 10 has been pushed out into the locking ring 9 recess 9*b*. Since the locking device 10 has been pushed out into the recess 9*b*, this has allowed the lower supporting body 6 to be brought into contact with the locking sleeve 7, whereby the sealing device 3 and the upper supporting body 4 have followed the movement of the lower supporting body 6. The movement of the upper supporting body 4 has also resulted in the loading devices 12 (only one is shown) having been rotated in the recesses 11 in towards the centre axis S, so as to subject the sealing device 3 to load, thereby causing the sealing device 3 to have been crushed. Fluid is now able to flow through the plug apparatus 1.

Figure 6:
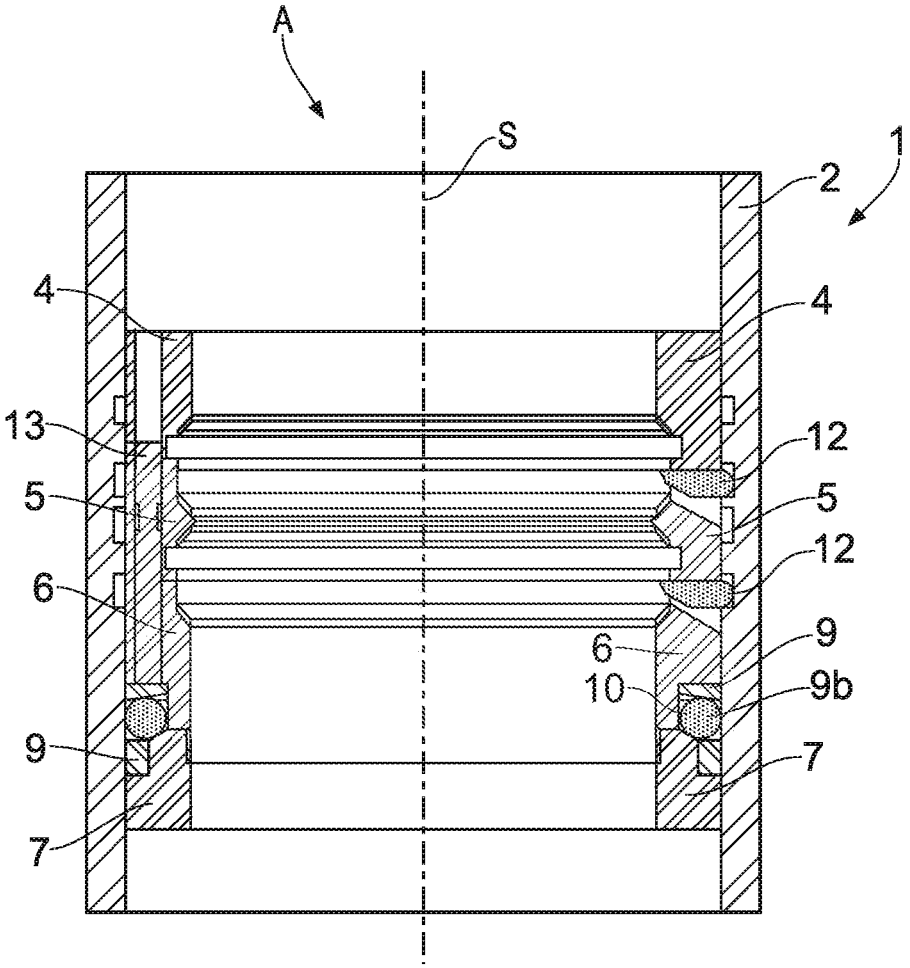
FIG. 6 is a cross-sectional view of the plug apparatus according to FIG. 2A in its open state.
Figure 7:
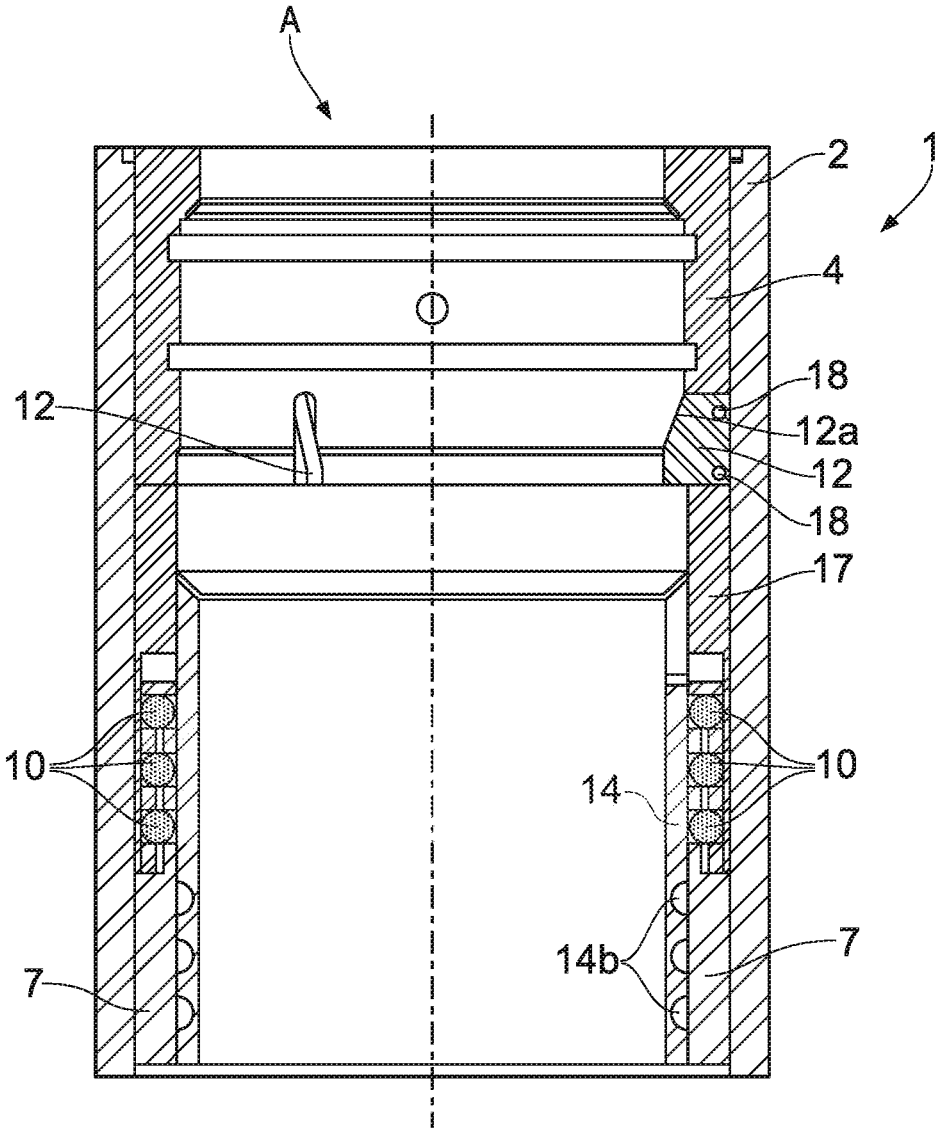
FIG. 7 is a cross-sectional view of the plug apparatus according to FIG. 4A in its open state.

Similarly, FIGS. 6 and 7 show a cross-section of the plug apparatus 1 according to FIGS. 2A-3B and FIGS. 4A-4D, when the plug apparatus 1 has been brought into its open position.

Figure 8:
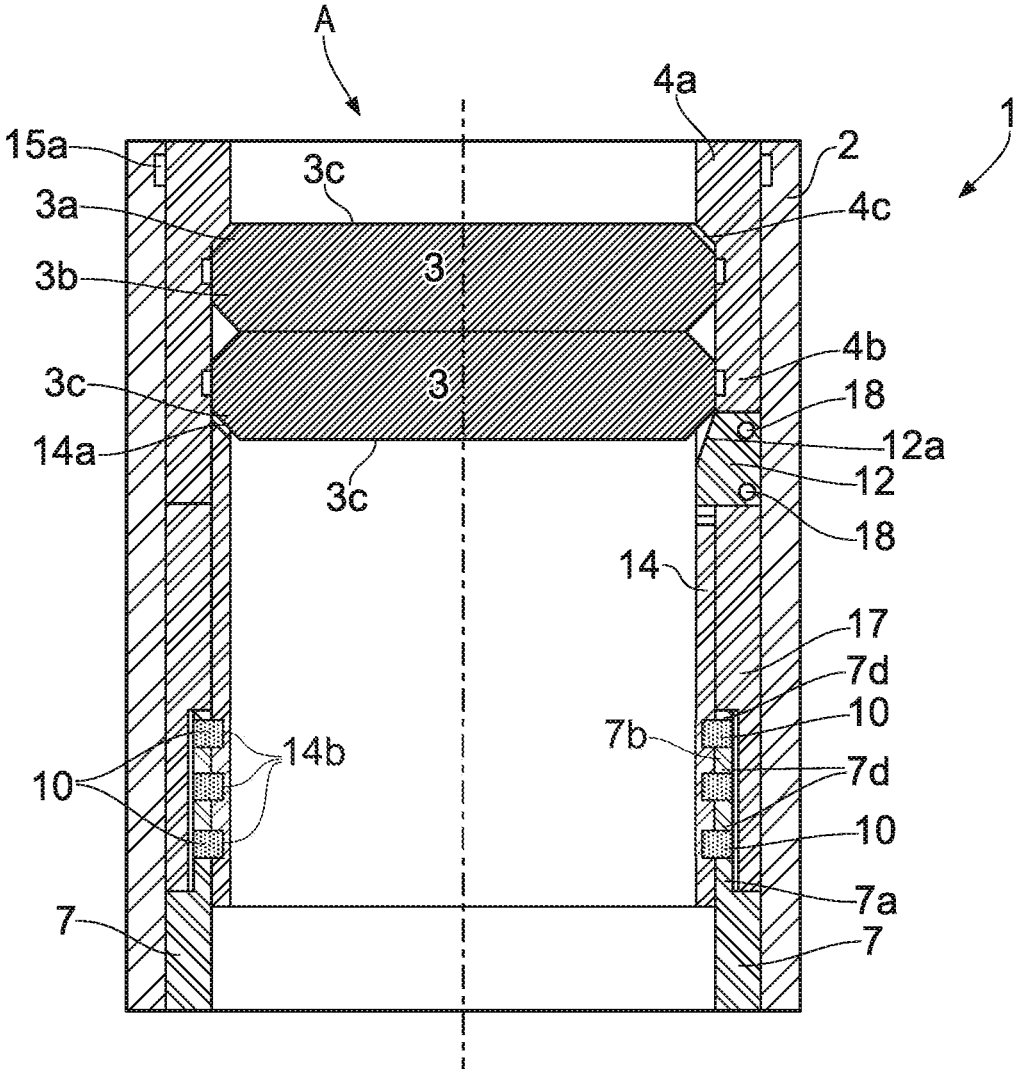
FIG. 8 is a cross-sectional view of a fourth embodiment of the plug apparatus according to the present invention in its closed state.

FIG. 8 shows a cross-section of a fourth embodiment of the plug apparatus 1 in its closed position according to the present application, the plug apparatus 1 comprising an outer housing 2 with a throughgoing axial bore A, so as to be able to receive an upper supporting body 4 and a ring element 17 in the recess. When the plug apparatus 1 is assembled, two sealing devices 3 will be disposed between the upper supporting body 4 and a retaining ring (locking ring) 14 that is arranged within the ring element 17.

Each sealing device 3 is configured with four bevelled edges 3*a*, formed between the side edges 3*b* and upper/lower surfaces 3*c* of the sealing device 3, so as by means of the bevelled edges 3*a* and side edges 3*b* to form retaining surfaces against the upper supporting body 4 and the retaining sleeve 14.

The upper supporting body 4 is designed to abut against the bevelled edges 3*a* and side edge 3*b* of the sealing device 3, the upper supporting body 4 over a first part 4*a* of its height being formed with a thickness or breadth B, whilst the upper supporting body 4 over a second part 4*b* of its height is configured with a smaller thickness or breadth b, the first and the second part 4*a*, 4*b* being connected to each other by means of a bevelled portion 4*c*.

The upper supporting body 4 will abut against the ring element 17 arranged therebelow, which ring element 17 in turn will abut against a locking sleeve 7 arranged therebelow. The locking sleeve 7 will be suitably fixedly connected to the inner surface of the outer housing 2. The locking sleeve 7 is further configured with a recess 7*a* that will form a projection 7*b* in the locking sleeve 7, in which the projection 7*b* three through openings 7*d* are formed.

To produce disintegration of the plug apparatus 1 sealing devices 3, the plug apparatus 1 also comprises a loading device 12, for example, in the form of a blade arrangement, which the loading device 12, via two bolts 18 or the like, is connected to the ring element 17. The loading device 12 will, on a side facing the sealing devices 3, be configured at least over a part of its height with a sloping edge 12*a*, which sloping edge 12*a* slopes downwards and outwards towards a centre axis S in the plug apparatus 1. In the side facing the inner surface of the outer housing 2, the loading device 12 is configured with a vertical edge, such that the loading device 12 can be arranged against the inner surface of the outer housing 2. This configuration of the loading device 12 will mean that the sealing devices 3 will be subjected to increasing load as they are moved past the loading device 12. The loading device 12 will then extend in towards a centre axis S of the plug apparatus 1 with a width that means that at least a part of the bevelled edge 3*a* and side edge 3*b* of the sealing devices 3 are subjected to a cutting open or rupturing by the loading device 12.

The retaining sleeve (locking ring) 14 will also be configured with a bevelled end edge 14*a* which is adapted to rest against the bevelled edge 3*a* of the lower seal 3 when the plug apparatus 1 is assembled so as to form a support for the seals 3 and the upper supporting body 4. The bevelled edge 14*a* will extend downwards from an outside of the retaining sleeve 14 towards an inside of the retaining sleeve (locking ring) 14.

The retaining sleeve (locking ring) 14 is at an opposite end to the bevelled end edge 14*a*, in an end area and on its outer surface configured with three recesses 14*b*, the recesses 14*b* being arranged spaced apart.

When the plug apparatus 1 is assembled, the recesses 7*d* in the locking sleeve and the recesses 14*b* in the retaining sleeve 14 will be aligned.

The retaining sleeve 14 and the locking sleeve 7 will thus be connectable to plurality of locking devices 10, these locking devices 10, for example, being in the form of shear pins.

Through the design of the plug apparatus 1 described above, the upper supporting body 4, the sealing devices 3 and the retaining sleeve 14 will "depend from" and be secured in position by the locking sleeve 7 and the locking devices 10.

The plug apparatus 1 is brought into its open state by applying pressure on the upper side 3*c* of the upper sealing device 3, whereby this will result in the retaining sleeve 14 subjecting the locking devices 10 to a load. After the locking devices 10 have been loaded above a predetermined value, the locking devices 10 will give way, whereby the retaining sleeve 14 and the sealing devices 3 are no longer supported by the locking sleeve 7. This will result in the sealing devices 3 being moved down towards the loading device 12, so as to be cut open or scratched.

When the retaining sleeve (locking ring) 14 and the sealing devices 3 have moved to a position in which the retaining sleeve 14 has come into contact with a receiving part 16, both sealing devices 3 will have been passed over and past the loading device 12, which has caused the sealing devices 3 to be weakened. The load of the weight of the liquid that lies on the upper side 3*c* of the upper sealing device 3 will then cause the sealing devices 3 to disintegrate.

Figure 9:
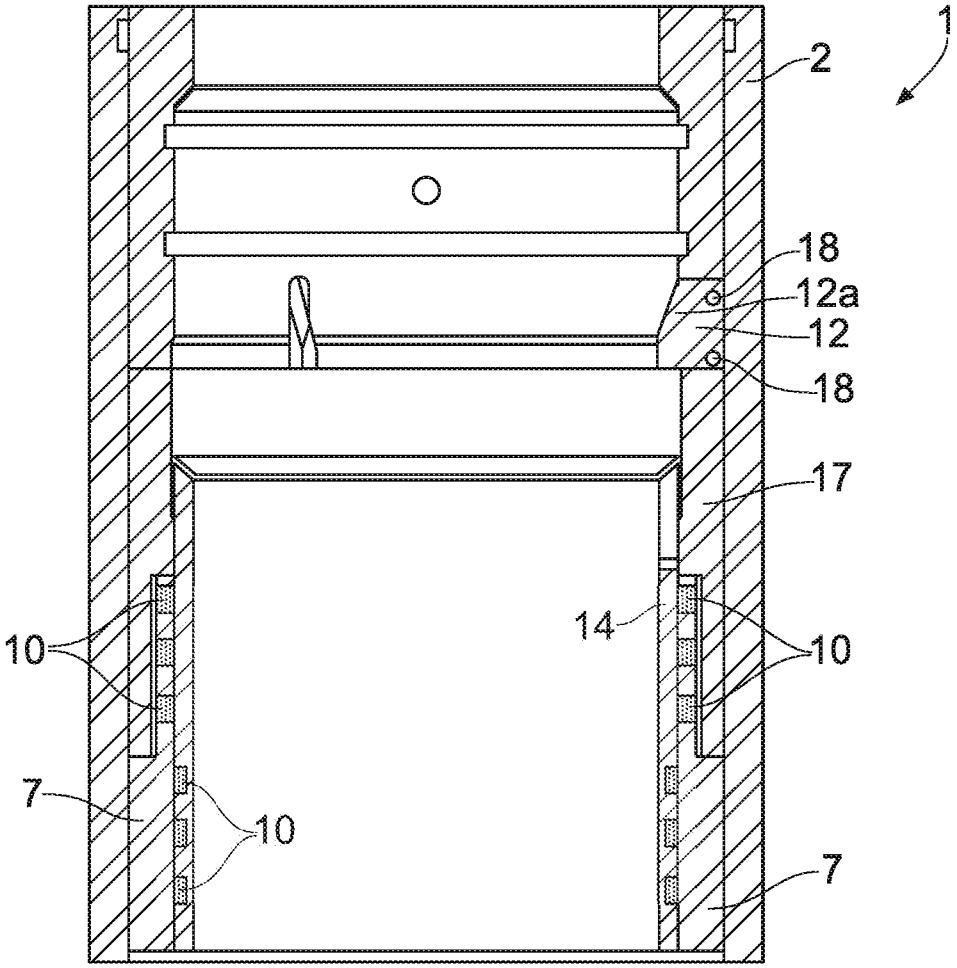
FIG. 9 is a cross-sectional view of the plug apparatus according to FIG. 8 in its open state.

FIG. 9 shows a cross-section of the plug apparatus 1 according to FIG. 8 in its open state, where it can be seen that the retaining sleeve (locking ring) 14, as a result of the effect of the fluid above the upper sealing device 3, has been released from the locking sleeve 7 in that the locking devices 10 have been cut, whereby the sealing devices 3 have been moved across and past the loading device 12 so as to be disintegrated.

Fluid may now flow through the plug apparatus 1.

The present invention has now been explained with reference to exemplary embodiments, but a person of skill in the art will understand that changes and modifications could be made to these exemplary embodiments which are within the scope of the invention as defined in the following claims.

The invention claimed is:

1. A plug apparatus for carrying out tests in a petroleum well, a pipe or a borehole, comprising an outer housing provided with a throughgoing axial bore, said outer housing surrounding at least one sealing device, wherein the plug apparatus further comprises a plurality of supporting bodies arranged in the throughgoing axial bore of the outer housing which support the at least one sealing device, where at least one of the supporting bodies is in engagement with a locking device for locking to a locking sleeve and a locking ring, and further wherein a channel is formed through the plurality of supporting bodies, within which channel a movable member is arranged to abut against the locking ring, where the at least one of the supporting bodies is brought out of engagement with the locking device after the application of predetermined force through the moveable member on the locking ring, whereby the at least one of the supporting bodies and the at least one sealing device are permitted an axial movement in the outer housing, this movement resulting in the at least one sealing device being brought into contact with loading devices adapted to subject the at least one sealing device to load so as to produce disintegration of the at least one sealing device.

2. A plug apparatus according to claim 1, wherein the loading devices comprise a plurality of pin devices, spikes or blades.

3. A plug apparatus according to claim 1 or 2, wherein an inner surface of the outer housing is configured with a plurality of recesses for receiving the loading devices, which recesses allow the loading devices to rotate in towards a centre axis in the plug apparatus on the axial movement of the at least one of the supporting bodies and the at least one sealing device.

4. A plug apparatus according to claim 1, wherein the at least one sealing device is glass, ceramics, or a combination thereof.

5. A plug apparatus according to claim 1, wherein sealing elements are arranged between the outer housing and the at least one of the supporting bodies and between the at least one of the supporting bodies and the at least one sealing device.

6. A plug apparatus according to claim 1, wherein the locking device comprises at least a ball, a roller, pawl or shear pin.

7. A plug apparatus according to claim 1, wherein a plurality of sealing devices are arranged adjacent one another.

8. A plug apparatus according to claim 1, wherein the at least one sealing device is configured with bevelled edges, which beveled edges are arranged between side edges and upper/lower surfaces.

9. A plug apparatus according to claim 1, wherein the locking ring is configured with at least one recess for receiving the locking device.

10. A plug apparatus according to claim 1, wherein a retaining sleeve is configured with a beveled edge.

11. A plug apparatus according to claim 1, wherein the outer housing on an inner surface is configured with a recess over a longitudinal direction for receiving the supporting bodies.

12. A plug apparatus according to claim 1, wherein the locking sleeve is fixedly connected to the inner surface of the outer housing.

13. A plug apparatus according to claim 1, wherein a gap is provided between the outer housing and the locking sleeve, in which gap the locking ring is arranged.

14. A plug apparatus according to claim 1, wherein the locking sleeve is configured with a projection, in which projection a plurality of through openings are provided.

15. A plug apparatus according to claim 1, wherein the outer housing is configured with a recess for receiving the locking sleeve.

* * * * *